US010111559B2

(12) United States Patent
Edwards et al.

(10) Patent No.: US 10,111,559 B2
(45) Date of Patent: Oct. 30, 2018

(54) HARDWARE ASSEMBLY

(71) Applicant: LIBERTY HARDWARE MFG. CORP., Winston-Salem, NC (US)

(72) Inventors: Neil Edwards, Kernersville, NC (US); Helli McDaniel, Whitsett, NC (US); Laura Hawkins, Madison, NC (US); Geraint Krumpe, Chicago, IL (US); William Spencer, Burlington, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 13/937,715

(22) Filed: Jul. 9, 2013

(65) Prior Publication Data

US 2015/0014505 A1 Jan. 15, 2015

(51) Int. Cl.
*A47K 1/09* (2006.01)

(52) U.S. Cl.
CPC ..... *A47K 1/09* (2013.01)

(58) Field of Classification Search
CPC ..... A47K 10/04; A47K 5/18; A47K 10/10; A47K 2201/00; A47K 1/09; F16B 9/026; F16B 35/005
USPC ..... 248/222.14, 251
See application file for complete search history.

(56) References Cited

U.S. PATENT DOCUMENTS 618,425 A * 1/1899 Manger ..... A47K 5/02 211/85.12
644,080 A * 2/1900 Huebel ..... A47K 5/02 211/85.12
904,150 A * 11/1908 Robinson ..... 211/123
970,485 A * 9/1910 Frey ..... A47K 5/02 211/85.12
1,117,771 A * 11/1914 Boehm ..... 211/123
1,425,459 A * 8/1922 Eggert ..... 211/123
D64,905 S * 6/1924 Jordan ..... D6/546
2,315,566 A * 4/1943 Watral et al. ..... 211/123
D144,567 S * 4/1946 Hoppe ..... D6/545
D145,934 S * 11/1946 Gerity ..... D6/533
2,451,550 A * 10/1948 Haller ..... A47G 7/044 248/315
D157,147 S * 2/1950 Hallenscheid ..... D6/535
2,522,174 A * 9/1950 Hermsmeyer ..... B60R 7/10 211/123
D173,824 S * 1/1955 Toner ..... D6/548
D189,838 S * 3/1961 Larson et al. ..... D6/533

(Continued)

FOREIGN PATENT DOCUMENTS

CH 128195 A * 10/1928 ..... A47K 10/04
CH 645798 A5 * 10/1984 ..... A47K 3/281

(Continued)

*Primary Examiner* — Muhammad Ijaz
(74) *Attorney, Agent, or Firm* — Brooks Kushman P.C.; Lora Graentzdoerffer

(57) ABSTRACT

A hardware assembly is provided with a base for mounting to a support surface, the base having a longitudinal axis. A receiving member extends outwardly from the base along the longitudinal axis, the receiving member having an aperture. A hardware component is mounted to the receiving member in a plane that includes the longitudinal axis. According to at least one embodiment, an accessory may be removably received within the receiving member aperture.

5 Claims, 9 Drawing Sheets

(56) References Cited

U.S. PATENT DOCUMENTS 3,866,873 A * 2/1975 Bohli ..... F16B 11/006 102/406
D253,380 S * 11/1979 Pittenger ..... D6/524
D271,234 S * 11/1983 Bennato ..... D6/535
4,465,198 A * 8/1984 Martin ..... A47K 10/04 211/105.3
D282,704 S * 2/1986 Burnett ..... D30/133
D283,283 S * 4/1986 Sollen ..... D6/535
D294,906 S * 3/1988 Pool ..... D6/531
4,773,348 A * 9/1988 Rowley ..... E02B 3/26 114/219
4,854,456 A * 8/1989 Lee ..... 211/14
D306,689 S * 3/1990 Hamann ..... D6/535
5,071,099 A * 12/1991 Kuo ..... A47K 10/10 248/224.7
D330,823 S * 11/1992 Gomes et al. ..... D6/529
5,186,427 A * 2/1993 Semchuck ..... A47K 10/04 248/224.7
D337,681 S * 7/1993 Sharpe ..... D6/531
D347,346 S * 5/1994 Shames et al. ..... D6/531
D349,206 S * 8/1994 Fischer ..... D6/536
D356,708 S * 3/1995 Shames ..... D6/527
5,429,252 A * 7/1995 Liu ..... A47K 1/08 211/105.1
5,433,152 A * 7/1995 Henry ..... 108/42
D369,050 S * 4/1996 Sargent et al. ..... D6/527
D371,735 S * 7/1996 Motta ..... D6/535
D386,342 S * 11/1997 Moore ..... D6/531
D386,343 S * 11/1997 Moore ..... D6/532
D402,144 S * 12/1998 Weirich ..... D6/524
D405,997 S * 2/1999 Mahlmann ..... D6/545
D416,153 S * 11/1999 Chen ..... D6/524
D416,730 S * 11/1999 Chen ..... D6/540
D417,993 S * 12/1999 Mahlmann ..... D6/542
D423,885 S * 5/2000 Duggan ..... D7/620
D424,348 S * 5/2000 Duggan ..... D6/540
D424,349 S * 5/2000 Duggan ..... D6/540
D425,742 S * 5/2000 Duggan ..... D6/535
D432,832 S * 10/2000 Gastelum et al. ..... D6/524
D432,834 S * 10/2000 Gastelum et al. ..... D6/531
D432,837 S * 10/2000 Gastelum et al. ..... D6/540
D432,842 S * 10/2000 Gastelum et al. ..... D6/549
D434,259 S * 11/2000 Gastelum et al. ..... D6/546
D435,434 S * 12/2000 Kampe ..... D8/363
D436,453 S * 1/2001 Gastelum et al. ..... D6/323
D436,478 S * 1/2001 Mahlmann ..... D6/535
D437,157 S * 2/2001 Gastelum et al. ..... D6/523
D437,159 S * 2/2001 Fiegl et al. ..... D6/535
D437,717 S * 2/2001 Solowiej ..... D6/535
D438,735 S * 3/2001 Mahlmann ..... D6/518
D441,232 S * 5/2001 Wu ..... D6/524
D441,236 S * 5/2001 Gottwald ..... D6/540
6,250,481 B1 * 6/2001 Chang et al. ..... 211/87.01
D451,326 S * 12/2001 Gottwald ..... D6/524
6,334,541 B1 * 1/2002 Chang ..... 211/88.01
D453,646 S * 2/2002 Gottwald ..... D6/535
D455,035 S * 4/2002 Meck et al. ..... D6/548
D455,589 S * 4/2002 Hoernig ..... D6/531
D456,195 S * 4/2002 Meck et al. ..... D6/549
D458,787 S * 6/2002 Meck et al. ..... D6/523
6,422,401 B1 * 7/2002 Roten ..... A47F 7/06 211/32
D461,353 S * 8/2002 Gilbert ..... D6/549
D472,089 S * 3/2003 Goodman et al. ..... D6/549
D475,878 S * 6/2003 Knable, III ..... D6/552
D476,838 S * 7/2003 Hoernig ..... D6/527
D477,169 S * 7/2003 Hoernig ..... D6/548
D477,732 S * 7/2003 Hoernig ..... D6/527
6,609,689 B1 * 8/2003 Knapp ..... 248/205.5
6,635,332 B1 * 10/2003 McArthur ..... 428/132
D481,571 S * 11/2003 Henderson et al. ..... D6/531
6,698,602 B2 * 3/2004 Taylor ..... 211/74
D492,526 S * 7/2004 Ayers et al. ..... D6/534
D493,646 S * 8/2004 Hoernig ..... D6/534
D494,397 S * 8/2004 Ayers et al. ..... D6/534
D498,379 S * 11/2004 Wu ..... D6/524
D507,443 S * 7/2005 Gilbert ..... D6/524
D555,959 S * 11/2007 Rubin ..... D6/550
D566,442 S * 4/2008 Rubin ..... D6/527
7,520,397 B1 * 4/2009 Segale ..... A47B 81/04 211/106
7,571,532 B2 * 8/2009 Zimmerman ..... A47H 1/142 211/123
D604,543 S * 11/2009 Urquiola ..... D6/535
7,900,798 B1 * 3/2011 Allen ..... A47K 1/09 221/1
8,550,263 B2 * 10/2013 Martin ..... A47K 1/08 211/105.3
8,671,545 B1 * 3/2014 Zimmerman ..... F16M 13/02 211/123
2002/0190170 A1 * 12/2002 Ting ..... 248/205.5
2004/0149875 A1 * 8/2004 Reynolds et al. ..... 248/309.1
2009/0223912 A1 * 9/2009 Chen ..... 211/48
2009/0308995 A1 * 12/2009 Kuo ..... A47K 10/10 248/231.91
2015/0014505 A1 * 1/2015 Edwards ..... A47K 1/09 248/251

FOREIGN PATENT DOCUMENTS

DE 477788 C * 6/1929 ..... A47K 10/04
DE 617022 C * 8/1935 ..... A47K 3/003
DE 29509390 U1 * 8/1995 ..... A47K 1/09
EP 0566937 A1 * 10/1993 ..... A47K 1/08
EP 0566937 B1 * 6/1996 ..... A47K 1/08
EP 1145675 A1 * 10/2001 ..... A47K 3/001

* cited by examiner

HARDWARE ASSEMBLY

TECHNICAL FIELD

Embodiments relate to hardware assemblies, such as for use with interchangeable accessories.

BACKGROUND

Hardware components, such as towel bars, tissue holders, towel rings, hooks, shelving, and the like are typically mounted to a support surface, such as a wall. The prior art has provided hardware assemblies with various post and base configurations.

SUMMARY

According to at least one embodiment, a hardware assembly is provided with a base for mounting to a support surface, the base having a longitudinal axis. A receiving member extends outwardly from the base along the longitudinal axis, the receiving member having an aperture. A hardware component is mounted to the receiving member in a plane that includes the longitudinal axis.

According to at least another embodiment, a hardware assembly is provided having first and second bases for mounting to a support surface, the first and second bases having first and second longitudinal axes, respectively. First and second receiving members extend outwardly from the first and second bases along the first and second longitudinal axes, respectively, the first and second receiving members each having an aperture. A hardware component is mounted to the first and second receiving members in a plane that includes the first and second longitudinal axes.

According to at least another embodiment, a hardware assembly is provided with a base for mounting to a support surface, the base having a longitudinal axis. A receiving member extends outwardly from the base along the longitudinal axis, the receiving member having an aperture. A hardware component is mounted to the receiving member in a plane that includes the longitudinal axis, and an accessory is removably received within the receiving member aperture.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
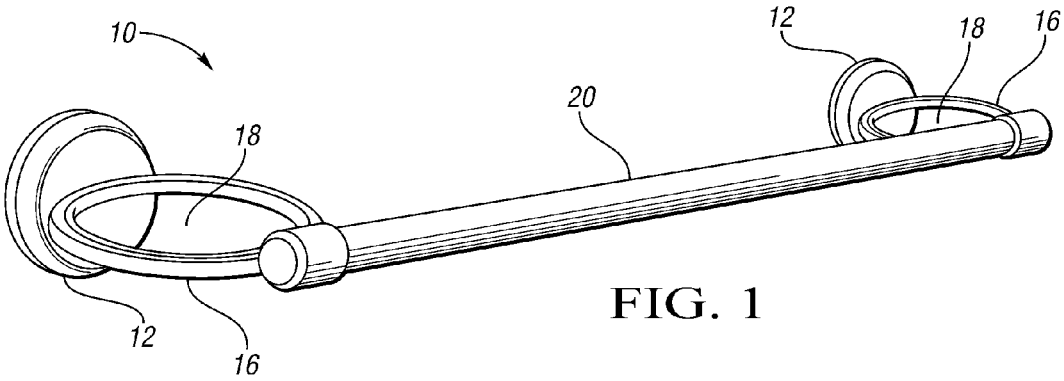
FIG. 1 is a perspective view of a hardware assembly including a towel bar according to an embodiment.
Figure 2:
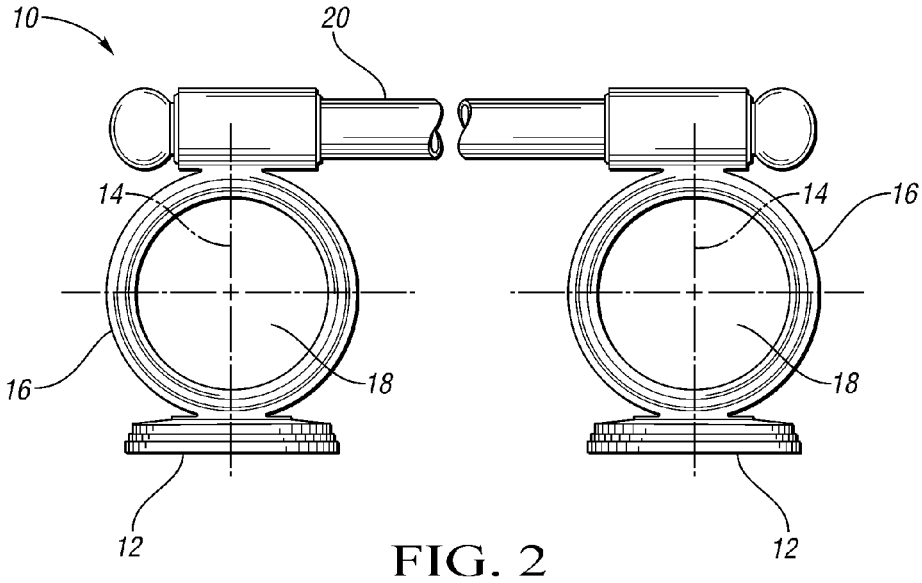
FIG. 2 is a top plan, fragmented view of the hardware assembly of FIG. 1.

With reference first to FIGS. 1 and 2, a hardware assembly 10 is illustrated according to an embodiment. The hardware assembly 10 includes a base 12 for mounting to a support surface, such as a wall, wherein the base 12 has a longitudinal axis 14 (see FIG. 2). Instead of a standard post, a receiving member 16, such as a ring, extends outwardly from the base 12 along the longitudinal axis 14. The receiving member 16 has an aperture 18, such as for removably receiving an accessory therein to provide additional functionality to the hardware assembly 10, as described further below. A hardware component 20, such as a towel bar, is mounted to the receiving member 16 in a plane that includes the longitudinal axis 14. In the embodiment depicted in FIGS. 1 and 2, first and second bases 12 are provided in spaced relationship, each base 12 having a longitudinal axis 14, and the hardware component 20 is mounted to first and second receiving members 16 extending outwardly from the first and second bases 12 along the first and second longitudinal axes 14, respectively.

Figure 3:
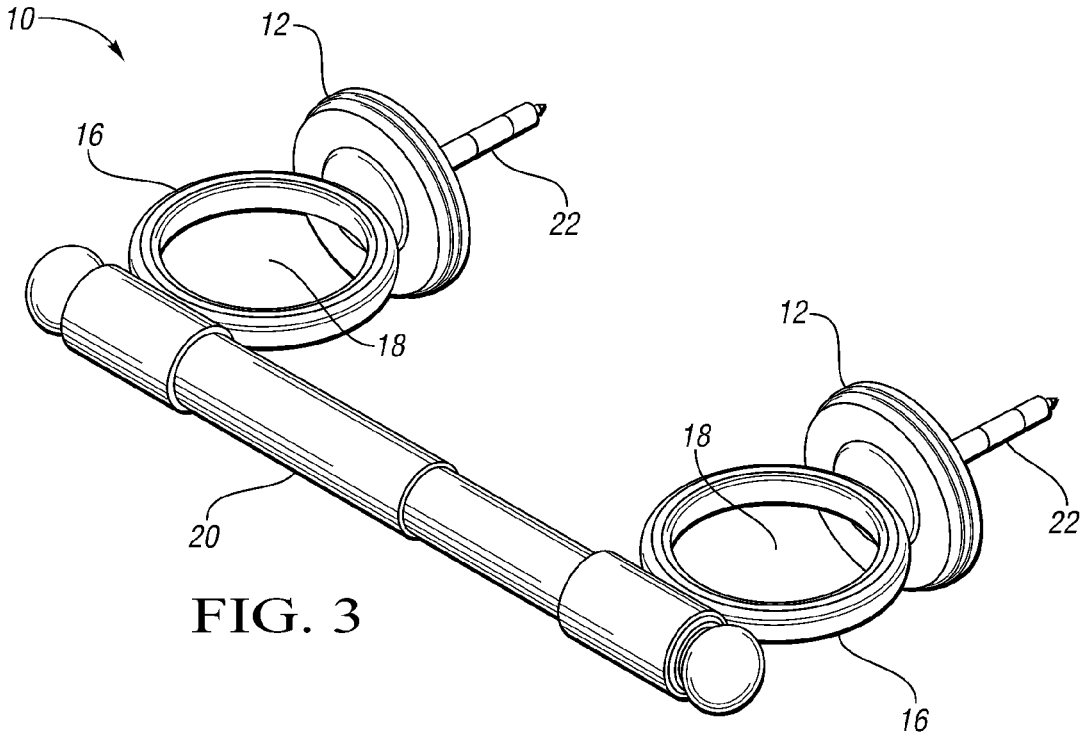
FIG. 3 is a perspective view of a hardware assembly including a tissue holder according to another embodiment.
Figure 4:
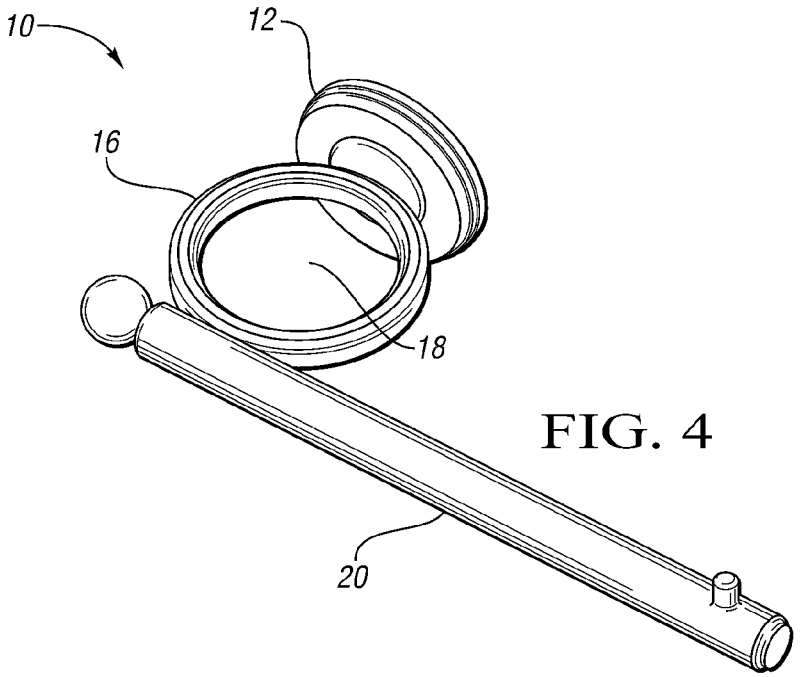
FIG. 4 is a perspective view of a hardware assembly including a tissue holder according to another embodiment.
Figure 5:
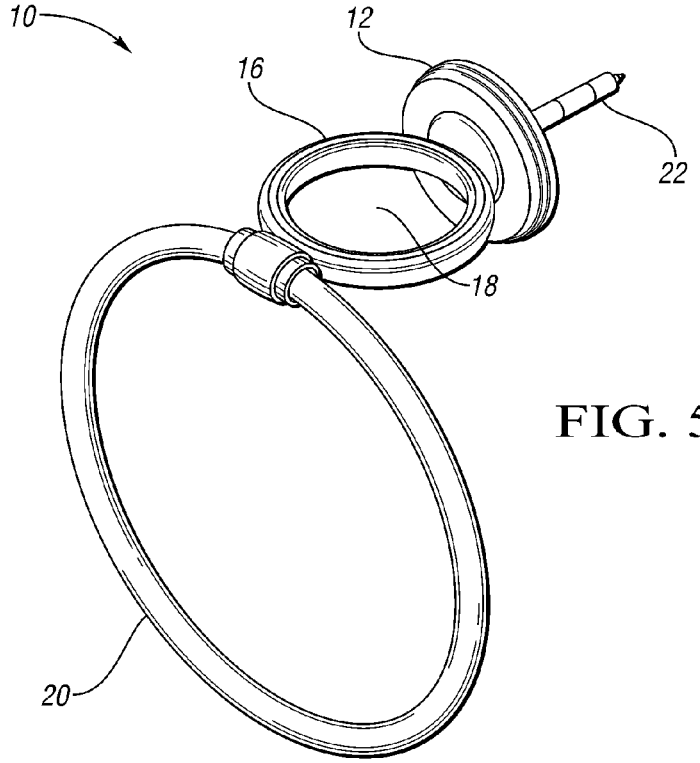
FIG. 5 is a perspective view of a hardware assembly including a towel ring according to another embodiment.

Although a hardware component 20 comprising a towel bar is illustrated in FIGS. 1 and 2, various domestic and commercial hardware components are contemplated, such as a tissue holder, towel ring, hook, shelf, and the like. For example, FIG. 3 illustrates an embodiment where the hardware component 20 comprises a tissue holder mounted between two receiving members 16, FIG. 4 illustrates an embodiment where the hardware component 20 comprises a tissue holder mounted to one receiving member 16, and FIG. 5 illustrates an embodiment where the hardware component 20 comprises a towel ring. With reference to FIGS. 3 and 5, the hardware assembly 10 may include a fastener assembly 22 such as, but not limited to, an expansion anchor, for fastening the base 12 to a support surface.

Figure 6:
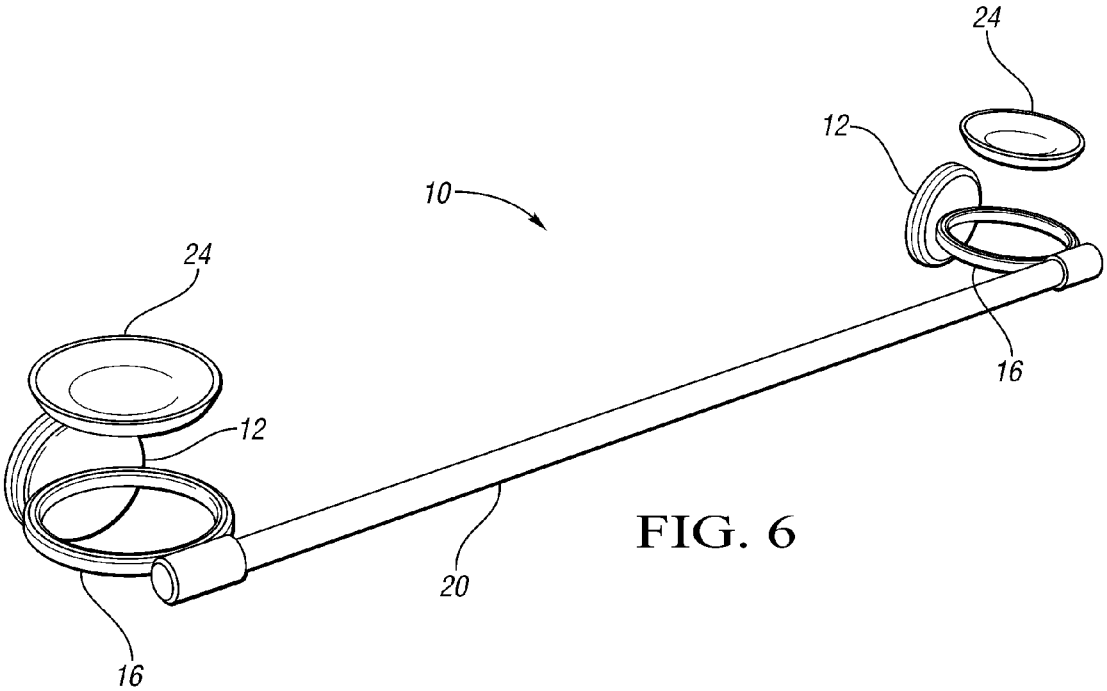
FIG. 6 is a perspective view of the hardware assembly of FIG. 1 set to receive tray accessories.
Figure 7:
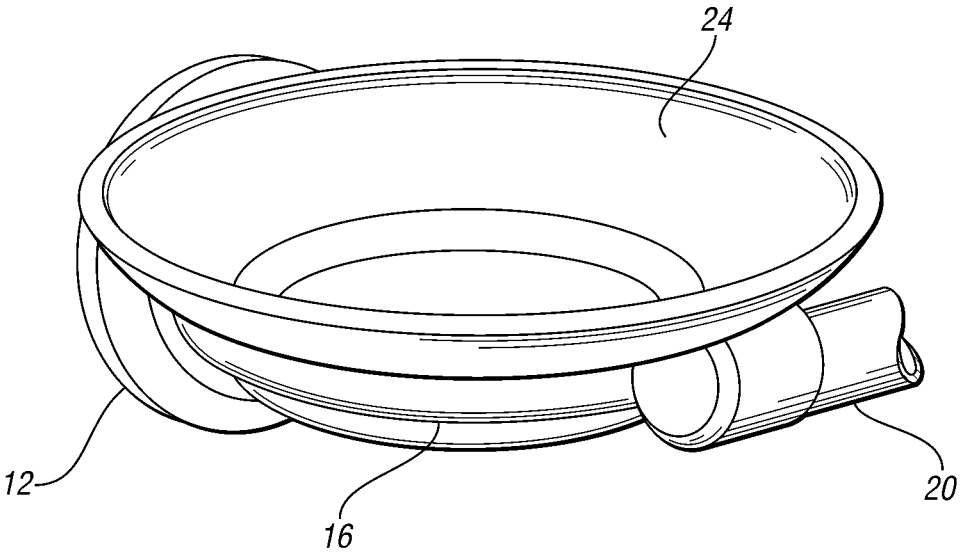
FIG. 7 is a perspective view, partially cut away, of the hardware assembly of FIG. 1 with a tray accessory received therein.
Figure 8:
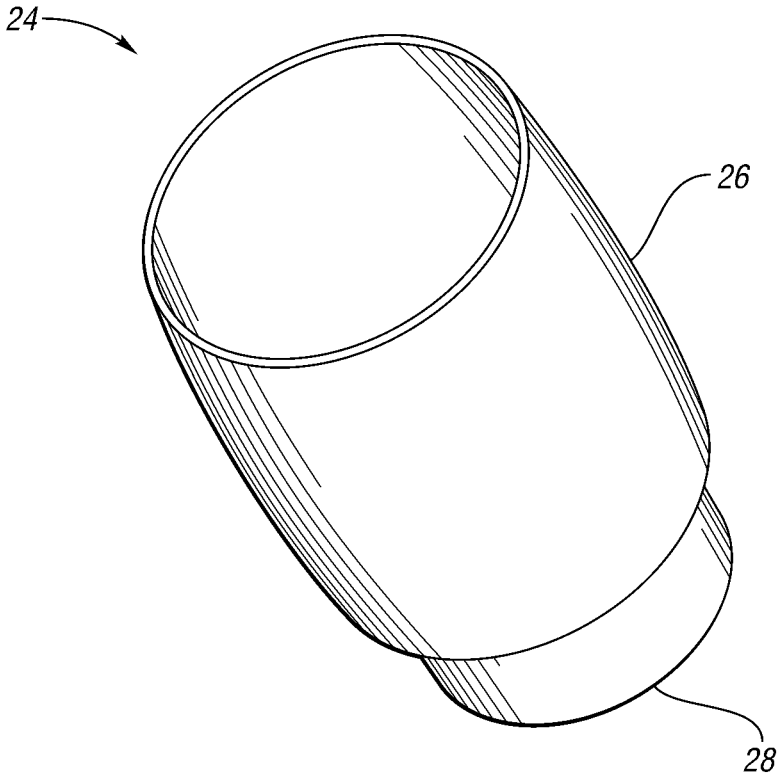
FIG. 8 is a perspective view of a cup accessory according to an embodiment.
Figure 9:
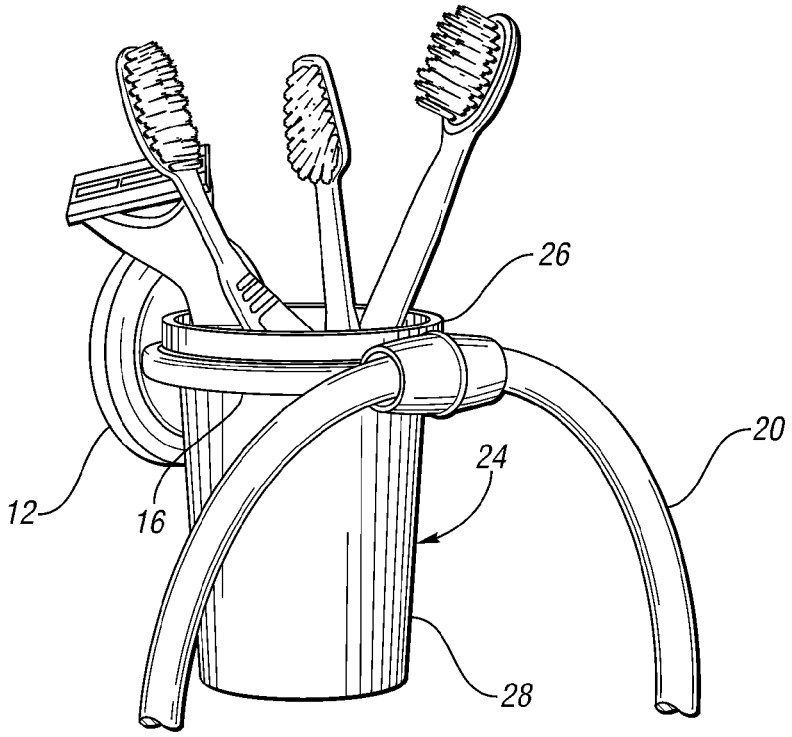
FIG. 9 is a perspective view of another cup accessory received within the hardware assembly of FIG. 5 according to an embodiment.
Figure 10:
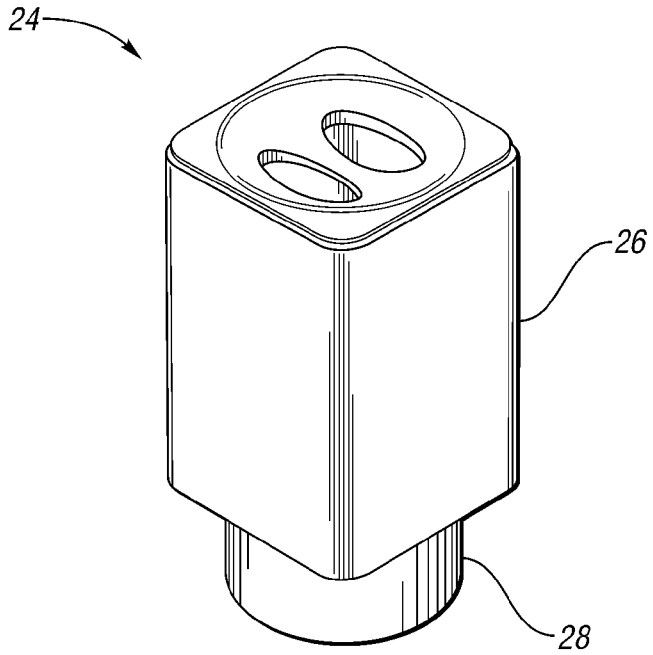
FIG. 10 is a perspective view of a toothbrush holder accessory according to an embodiment.
Figure 11:
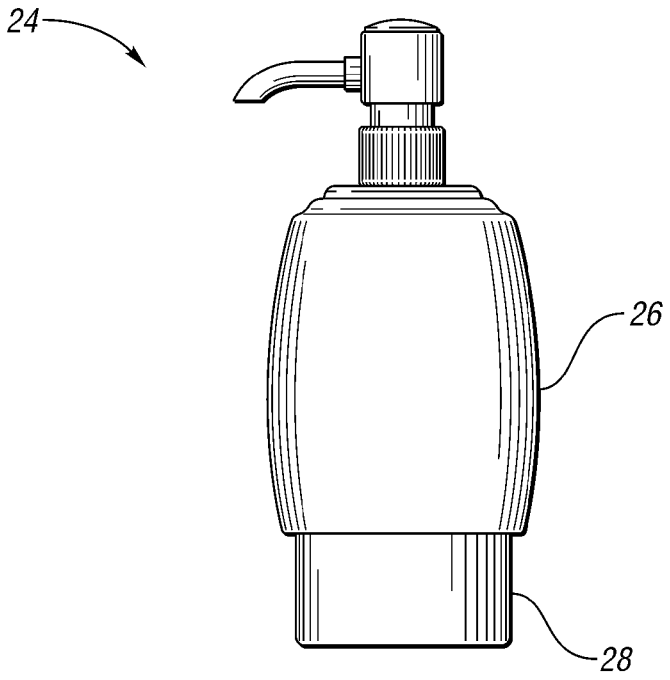
FIG. 11 is a side elevation view of a liquid dispenser accessory according to an embodiment.
Figure 12:
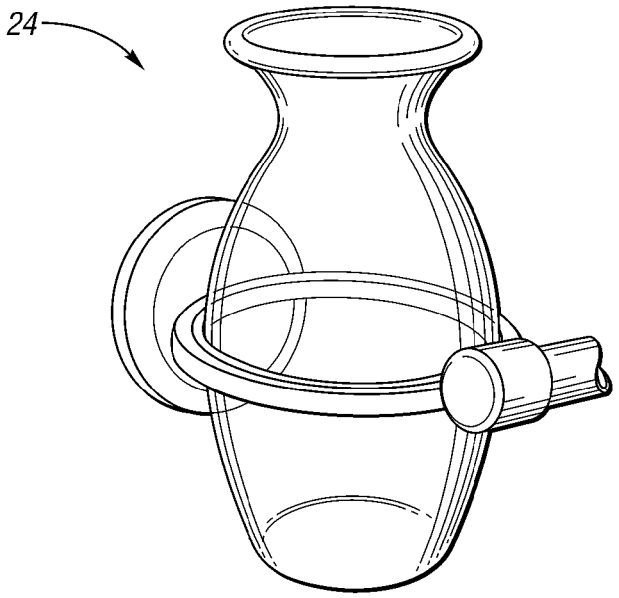
FIG. 12 is a perspective view, partially cut away, of the hardware assembly of FIG. 1 with a vase accessory received therein.

The receiving member 16 provides a storage solution built into the design of the hardware assembly 10 for temporary and permanent storage of everyday items. The receiving member 16 may removably receive a plurality of interchangeable accessories 24, allowing a user to increase the functionality of the hardware assembly 10 as well as to personalize their hardware and provide additional decorative options. For example, FIG. 6 shows the hardware assembly 10 of FIG. 1 set to receive tray or dish accessories, and FIG. 7 illustrates a tray accessory received within the receiving member 16. As further examples, FIG. 8 depicts a cup or tumbler accessory, FIG. 9 depicts another embodiment of a cup or tumbler accessory, FIG. 10 depicts a toothbrush holder accessory, FIG. 11 depicts a liquid dispenser accessory, such as a soap or lotion dispenser, and FIG. 12 depicts a vase accessory, although other accessories are also contemplated. For hardware assemblies 10 with more than one receiving member 16, each receiving member 16 may receive the same or different types of accessories 24 therein, allowing a user to customize the hardware assembly 10 based upon their decorative and functional needs.

Figure 13:
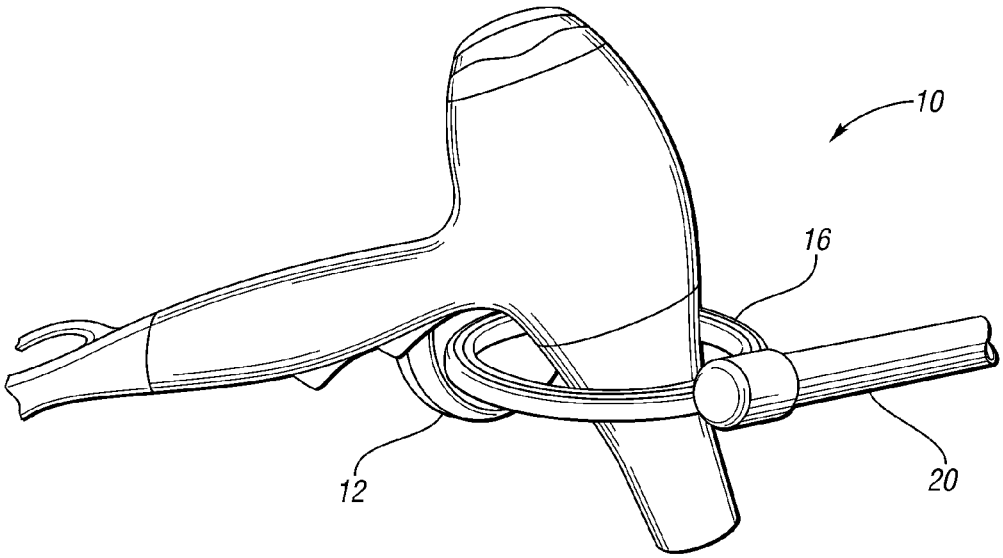
FIG. 13 is a perspective view, partially cut away, of the hardware assembly of FIG. 1 with a hair dryer received therein.

In addition to receiving accessories 24, the receiving member 16 may be used to store items such as curling irons or hair dryers, as depicted in FIG. 13, or as a location to hang hooks or hangers for additional storage. Although a generally circular aperture 18 is depicted, the aperture 18 may have any curvilinear or polygonal configuration. The hardware assembly 10 offers storage and aesthetic solutions for multiple rooms in the home such as, but not limited to, the bathroom, kitchen, and laundry room.

Figure 14:
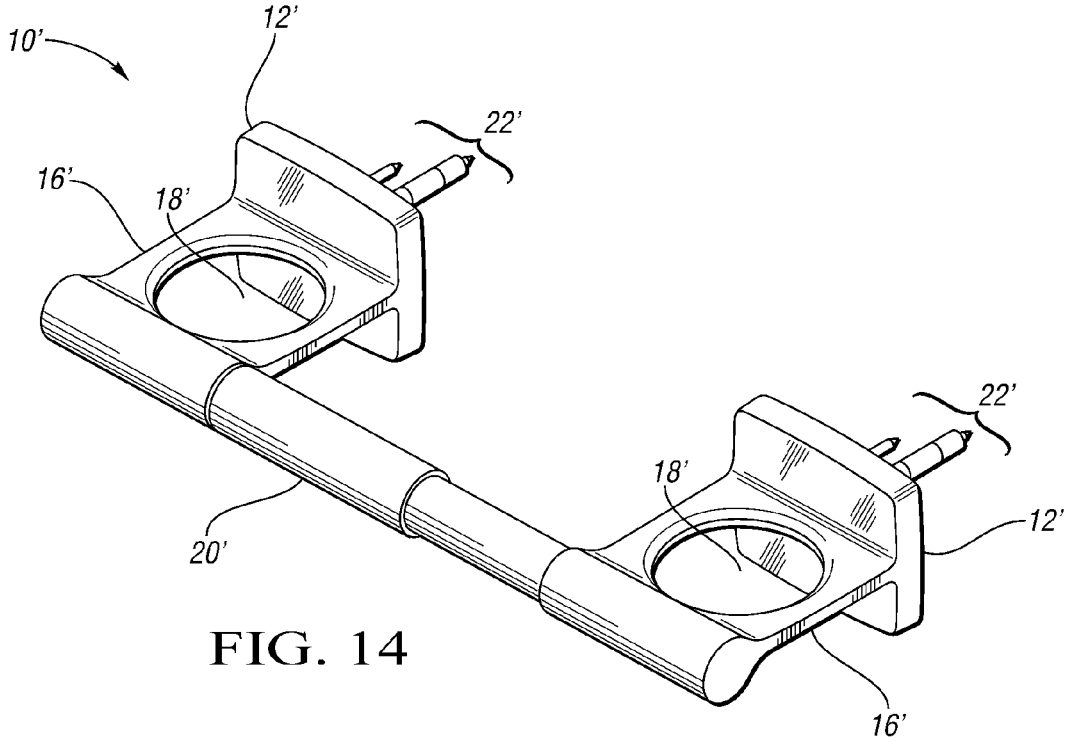
FIG. 14 is a perspective view of a hardware assembly including a tissue holder according to an embodiment.
Figure 15:
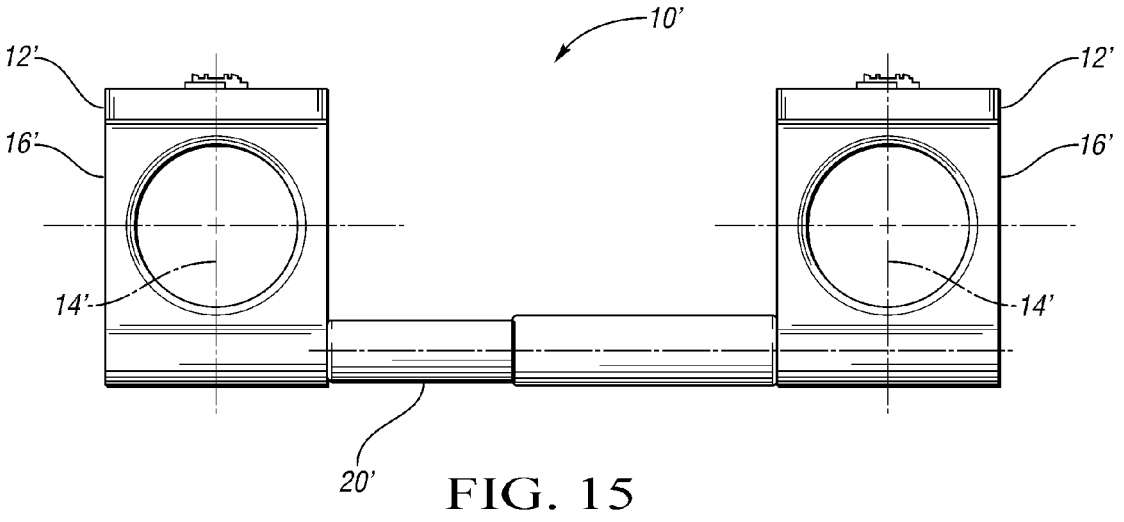
FIG. 15 is a top plan view of the hardware assembly of FIG. 14.
Figure 16:
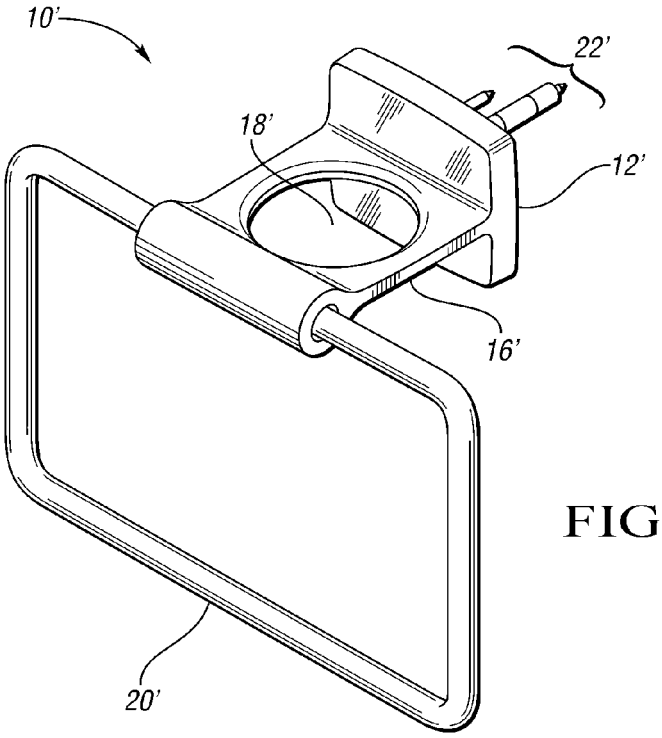
FIG. 16 is a perspective view of a hardware assembly including a towel ring according to another embodiment.
Figure 17:
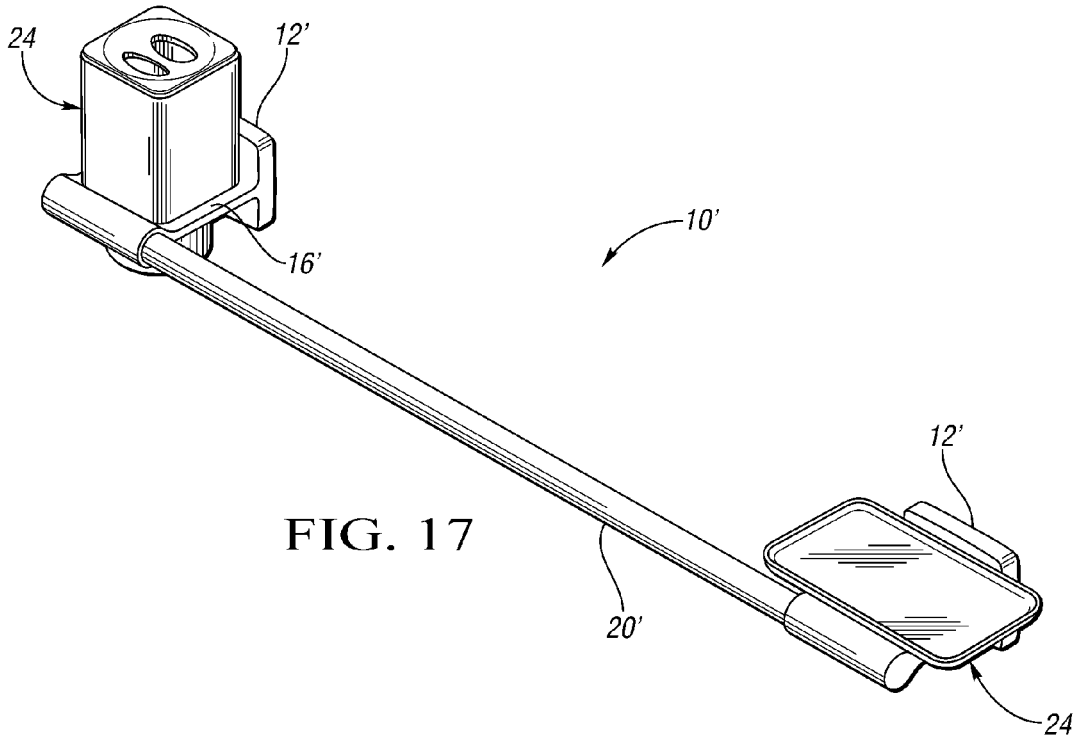
FIG. 17 is a perspective view of a hardware assembly including a towel bar with toothbrush holder and tray accessories received therein according to an embodiment.

In another embodiment, the receiving member 16' may have a platform configuration with an aperture 18' therein as shown in FIGS. 14-17. Features described above for the embodiments of FIGS. 1-6 are also applicable to the embodiments of FIGS. 14-17, and like components are given like reference numerals with the addition of a prime (') designation. A hardware component 20' comprising a tissue holder is illustrated in FIGS. 14 and 15, and a hardware component 20' comprising a towel ring is shown in FIG. 16. Of course, as described above, other hardware components are also contemplated. FIG. 17 illustrates a hardware assembly 10' including a towel bar with toothbrush holder and tray accessories 24 received therein according to an embodiment.

Figure 18:
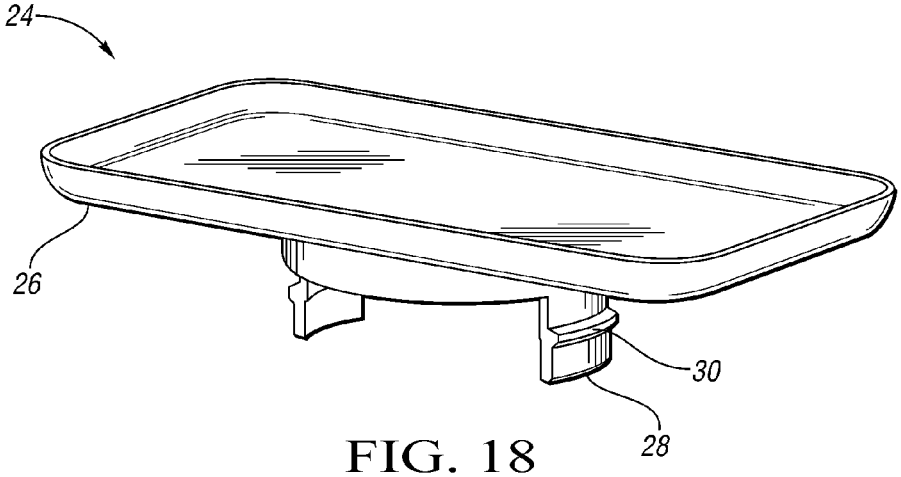
FIG. 18 is a perspective view of a tray accessory having a retention feature according to an embodiment.

As shown, for example, in FIGS. 8, 10 and 11, the accessory 24 may include an upper portion 26 and a lower portion 28, wherein the upper portion 26 has a greater diameter than the lower portion 28. The lower portion 28 may be received within the receiving member aperture 18 with the upper portion 26 resting on the receiving member 16, 16'. In an embodiment shown in FIG. 18, the lower portion 28 may be flexible and include at least one protrusion 30, so that when the accessory 24 is inserted into the receiving member 16, 16', the lower portion 28 deflects allowing the protrusion 30 to pass through the receiving member aperture 18, 18' and retain the accessory 24 within the receiving member 16, 16', such as in a snap-fit manner. Although the protrusion 30 is illustrated herein on the lower portion 28 of a tray or dish-type accessory, other types of accessories may also include such a feature.

Since the receiving member 16, 16' replaces a standard post in the hardware assembly 10, 10', the receiving member 16, 16' offers additional functionality while maintaining a compact footprint of the hardware assembly 10, 10' within the desired living space, and minimizes the packaging required. In the embodiment of FIGS. 1-6, less than 25% of the receiving member 16 extends beyond the base 12 in a transverse direction, and in the embodiment of FIGS. 14-17, the receiving member 16' does not extend beyond the base 12' in a transverse direction. Furthermore, the integration of the receiving member 16, 16' into the hardware assembly 10, 10' in place of a post avoids obfuscating the overall design appearance of the hardware assembly 10, 10'.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hardware assembly, comprising:

first and second bases each having a first surface and an opposed planar second surface, the first surface for contacting a support surface, the first and second surfaces having substantially similar areas, the first and second bases having first and second longitudinal axes, respectively, the first longitudinal axis transecting the first and second surfaces of the first base, and the second longitudinal axis transecting the first and second surfaces of the second base;

first and second planar rings each having an outer edge directly contacting the planar second surfaces of the first and second bases along the first and second longitudinal axes, respectively, the first and second planar rings each having an aperture formed about an axis perpendicular to the longitudinal axis; and a hardware component mounted to the first and second planar rings in a plane that includes the first and second longitudinal axes.

2. The hardware assembly of claim 1, wherein the hardware component comprises a towel bar.

3. The hardware assembly of claim 1, wherein the aperture is curvilinear.

4. The hardware assembly of claim 1, wherein the hardware component comprises a tissue holder.

5. The hardware assembly of claim 1, wherein the hardware component comprises a towel ring.

* * * * *